United States Patent [19]

Levin

[11] 4,176,669

[45] Dec. 4, 1979

[54] METHOD OF ATTACHING HAIR PIECES

[76] Inventor: Don Levin, 453 Kelton, Los Angeles, Calif. 90024

[21] Appl. No.: 801,554

[22] Filed: May 31, 1977

[51] Int. Cl.[2] ..... A41G 3/00

[52] U.S. Cl. ..... 132/53; 132/5

[58] Field of Search ..... 132/53, 5, 7, 54; 3/1

[56] References Cited

U.S. PATENT DOCUMENTS

| | | | |
|---|---|---|---|
| 2,907,334 | 10/1959 | Le Mole | 132/5 |
| 3,189,035 | 6/1965 | Heck | 132/5 |
| 3,385,305 | 5/1968 | Buzzelli | 132/53 |
| 3,420,249 | 1/1969 | Bonham | 132/53 |
| 3,495,603 | 2/1970 | Young, Jr. | 132/53 |
| 3,553,737 | 1/1971 | Bauman | 132/5 |
| 3,605,761 | 9/1971 | Margo | 132/5 |
| 3,908,674 | 9/1975 | Kessler | 132/53 |

*Primary Examiner*—G. E. McNeill

*Attorney, Agent, or Firm*—Ralph B. Pastoriza

[57] ABSTRACT

The method involves coating the periphery of a bald area on a person's head with a silicone adhesive sealant to define a peripheral track. The sealant actually penetrates the pores of the scalp and provides a mechanical coupling. Reinforcing material is in turn embedded after applying layers of the coating within this coating about the marginal edge of the bald spot. The marginal track or coatings are permitted to dry and the hair supporting base material of a hair piece is then stitched to the reinforcing material in the marginal track to thereby secure the hair piece in place.

4 Claims, 5 Drawing Figures

METHOD OF ATTACHING HAIR PIECES

This invention relates to an improved method of attaching hair pieces or hair replacements to one or more bald areas on a person's head.

BACKGROUND OF THE INVENTION

In spite of their long existence and popularity, there still has not been provided a really satisfactory method of securing a toupee or hair piece to a bald area on a person's head. Presently available attaching methods and means involve double sided sticky tape, various types of adhesives or glues or attempts to weave the replacement hair with healthy hair at the marginal edges of the bald spot.

After prolonged use, the double stick type of tape eventually loses its effectiveness. In the case of various available adhesives and glues, there is a tendency for the same to plasticize as a consequence of perspiration and the like which breaks down the adhesive. The glues thus become gummy and gooey and the hair piece will not always remain in its proper set position. Weaving the hair piece edges to adjacent healthy hair works for awhile, but upon growth of the healthy hair, reworking of this attachment means is necessary.

Because of the foregoing problems, various other solutions to covering up bald spots are available and presently in use. One of these is actual hair transplant. A problem with hair transplant is that the hair removed for purposes of transplant normally does not regrow with the result that another bald spot is produced in an effort to eclipse one bald spot. Moreover, hair transplants are extremely expensive and time consuming.

Still another proposed solution is to effect actual surgery on a person's head by implanting a ring of wire about the marginal edge of the bald spot and then stitch a hair piece directly to this wire. Aside from the fact that surgery itself is a rather radical type of operation for the purpose of attaching a hair piece, it is found that the scalp itself tends to reject any foreign material such as a wire embedded therein. Further, there is always the problem of possible infection and the like.

BRIEF DESCRIPTION OF THE PRESENT INVENTION

With the foregoing considerations in mind, the present invention contemplates an improved method of attaching hair pieces or hair replacements to a bald area on a person's head which avoids all of the various disadvantages associated with presently known methods.

More particularly, I have found that it is possible to build up a marginal track from a silicone adhesive sealant about the periphery of a bald spot. This silicone adhesive sealant tends to work into the pores of the scalp and effect an actual mechanical bonding to the scalp without any cutting or surgery. By applying several layers of this coating permitting each layer to dry after it is applied, an appropriate marginal track can be built up sufficient to support a hair piece. In this respect, an essential step of this method involves the embedding of a reinforcing material within this marginal track, a last layer of silicone sealant being applied over the reinforcing material. The hair supporting base material of the hair piece itself is then simply stitched preferably by a monofilament thread to the reinforcing material embedded in the silicone.

By the foregoing method, the hair piece is substantially permanently attached to cover the bald area. Further, problems of plasticizing of glues and so forth are avoided, the silicone itself being actually cured in the presence of water.

Further, the entire process or method is relatively inexpensive and is in no way dangerous to the patient.

In accord with the broadest concept of the method, the steps include: coating at least portions of the bald area with a bonding material; embedding reinforcing material in the bonding material; and stitching the hair piece to the reinforcing material.

BRIEF DESCRIPTION OF THE DRAWINGS

A better understanding of the method of this invention will be had by referring to the accompanying drawings in which.

DETAILED DESCRIPTION OF THE PREFERRED METHOD

Figure 1:
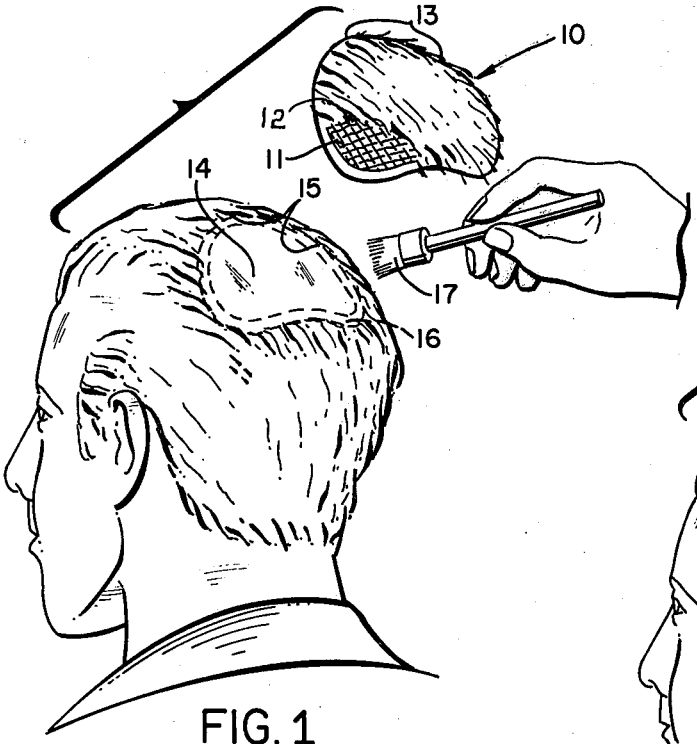
FIG. 1 is a three quarter rear perspective view of a person's head having a bald spot to which a hair piece is to be secured in accord with the method of this invention, the hair piece itself being shown exploded away from the person's head.

Referring first to FIG. 1, there is shown exploded away from a person's head a hair piece or hair replacement 10. Generally, this hair piece or replacement constitutes hair individually knotted to a hair supporting base material such as a nylon net 11 as illustrated in the broken away portion. Knotting of an individual hair to an intersection point of the warps and woofs making up the net 11 is indicated at 12.

The periphery of the hair supporting base material 11 is cut into a particular contour or shape 13 to correspond to the periphery or marginal edge of a bald area 14 on a person's head. This peripheral portion of the bald area is indicated at 15 in FIG. 1.

In accord with a first step of the preferred method, the perimeter of the bald area is coated with a silicone adhesive sealant which penetrates the pores of the skin and cures in the presence of water to define a marginal track 16 about the periphery 15 of the bald area. This track which is outlined in dashed lines in FIG. 1 may be from $\frac{1}{4}$ to $\frac{3}{4}$ inch in width. The silicone adhesive sealant is readily available from Dow Chemical Company and is identified as "Silicone Adhesive Sealant #734".

Actual application of the coating to define the marginal track 16 may be by a brush 17 as indicated.

After providing the coating as described in FIG. 1, it is permitted to dry for from two to five minutes. Thereafter, the marginal track 16 is again coated with a second layer of the silicone adhesive sealant. This second layer is then permitted to dry for a similar length of time from two to five minutes.

The second layer is then coated with a third layer of the silicone adhesive sealant but this third layer is permitted to only partially dry to a tacky consistence over a period of less than two minutes.

Figure 2:
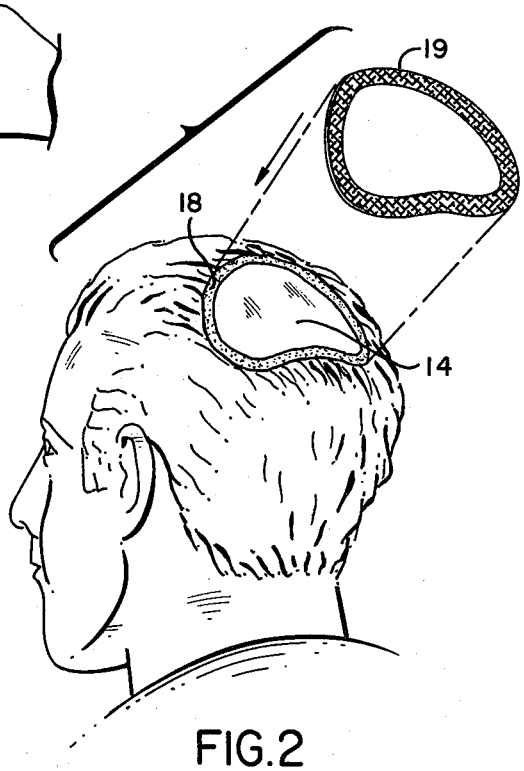
FIG. 2 is a view similar to FIG. 1 showing a subsequent step in the method.

Referring to FIG. 2, the second layer is indicated at 18. Then in accord with a next step of the method, a reinforcing material 19 preferably of less width than the marginal track is disposed on the third layer 18 while in a tacky state; that is, the reinforcing material 19 is urged or embedded in the third layer 18. In the particular example illustrated in FIG. 2, the reinforcing material 19 may constitute a nylon mesh strip of the same or similar material to the hair supporting base material 11 described in FIG. 1 for the hair piece 10.

Figure 3:
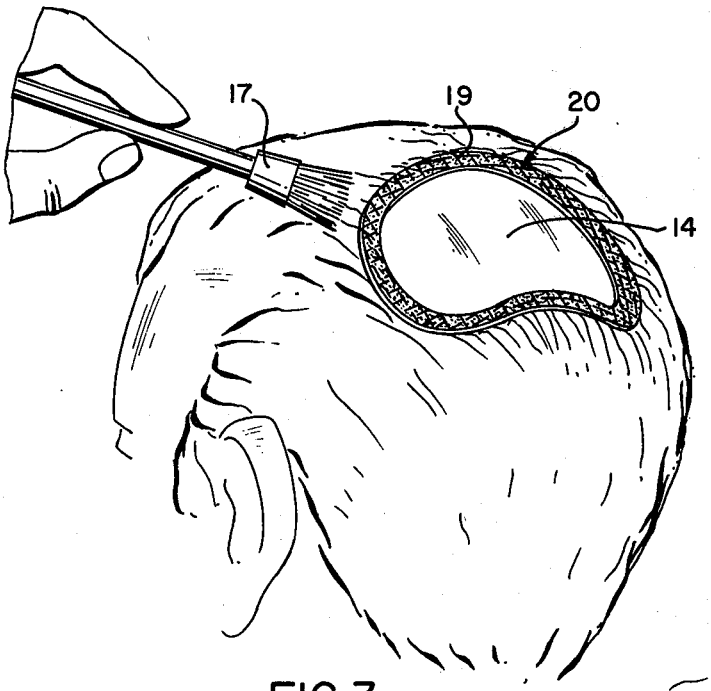
FIG. 3 is a view similar to FIG. 1 showing a still further step in the method.

Referring to FIG. 3, after the third layer has been permitted to completely dry to thus set the reinforcing material 19 in place, a fourth layer is coated over the third layer, this fourth layer again comprising silicone adhesive sealant and being indicated at 20 in FIG. 3. The brush 17 may be used for each of the applications in question.

As in the case of the first and second layers, the fourth layer 20 is permitted to dry for from two to five minutes.

Figure 4:
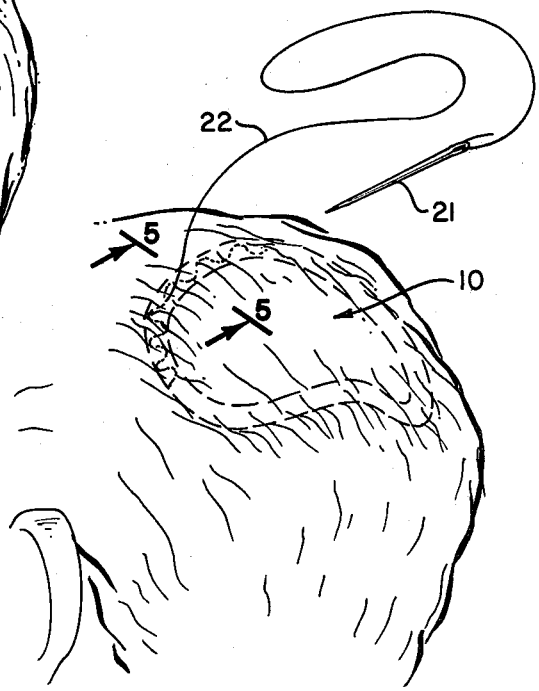
FIG. 4 is another view similar to FIG. 1 illustrating still another step of the method.

FIG. 4 illustrates a still subsequent step wherein the hair piece 10 has been applied to the bald area with the peripheral edge of the hair supporting base material overlying the fourth layer. After appropriate placement of the hair piece, the final step of the method involves simply stitching as by means of a needle 21 and monofilament transparent thread 22 the peripheral edge of the hair supporting base material to the reinforcing material embedded under the fourth layer. This stitching will take place about the entire periphery so that the hair piece is mechanically held to the marginal track about its entire periphery.

Figure 5:
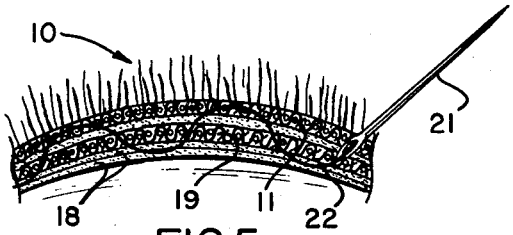
FIG. 5 is a fragmentary sectional view taken in the direction of the arrows 5—5 of FIG. 4 illustrating a last step in the method.

FIG. 5 illustrates one example of the stitching wherein the stitching thread passes over and under various ones of the warps and woofs making up the respective nylon meshes 11 and 19.

It will be realized from the foregoing described method that a greatly improved process is set forth for attaching hair pieces or hair replacements to bald areas on a person's head. The silicone adhesive sealant is in no way harmful to the person's scalp notwithstanding the fact that it tends to penetrate the skin and interlock with the pores to provide a mechanical gripping. With the marginal track made up of this silicone adhesive sealant, secured in position and with the reinforcing material securely embedded therein, the final step of stitching assures that the hair piece will be permanently and properly locked in place.

I claim:

1. A method of attaching a hair piece to cover a bald area on a person's head wherein the contour of the hair supporting base material of the hair piece has been cut to correspond to the perimeter of the bald area, including the steps of:

(a) coating the perimeter of said bald area with a bonding material which penetrates the pores of the skin and cures in the presence of water to define a marginal track about the peripheral edge of the bald area which is effectively mechanically locked to the scalp;

(b) embedding a reinforcing material in said marginal track while in a tacky state so as to be retained in its set position after said bonding material completely dries; and (c) stitching the periphery of said hair supporting base material of said hair piece to said reinforcing material in said marginal track.

2. The method of claim 1, in which said bonding material comprises a silicone adhesive sealant.

3. A method of attaching a hair piece to cover a bald area on a person's head, wherein the contour of the hair supporting base material has been cut to correspond to the perimeter of the bald area, comprising the steps of:

(a) coating the perimeter of said bald area with a silicone adhesive sealant which penetrates the pores of the skin and cures in the presence of water to define a marginal track about the peripheral edge of the bald area of from $\frac{1}{4}$ to $\frac{3}{4}$ inch in width;

(b) permitting said marginal track to dry for from two to five minutes;

(c) coating said marginal track with a second layer of silicone adhesive sealant;

(d) permitting said second layer to dry for from two to five minutes;

(e) coating said second layer with a third layer of said silicone adhesive sealant;

(f) permitting said third layer to partially dry to a tacky consistency over a period less than two minutes;

(g) embedding a reinforcing material of less width than said marginal track in said third layer while in a tacky state;

(h) permitting said third layer to completely dry after embedding said reinforcing material so that said reinforcing material is set in said third layer;

(i) coating over said third layer and said reinforcing material with a fourth layer of said silicone adhesive sealant;

(j) permitting said fourth layer to dry for from two to five minutes;

(k) applying said hair piece to said bald area with the peripheral edge of said hair supporting base material overlying said fourth layer; and (l) stitching with a monofilament transparent thread said peripheral edge of said hair supporting base material to said reinforcing material embedded under said fourth layer, whereby said hairpiece is mechanically held to said marginal track about its entire periphery.

4. The method of claim 3, in which said hair supporting base material is in the form of a nylon mesh and in which said reinforcing means is in the form of a strip of a similar nylon mesh material, said stitching thread passing over and under various ones of the warps and woofs making up the respective nylon meshes.

* * * * *